US008910336B2

(12) United States Patent
Han

(10) Patent No.: US 8,910,336 B2
(45) Date of Patent: Dec. 16, 2014

(54) UPPER STRUCTURE FOR BRIDGE

(75) Inventor: Man-Yop Han, Yongin-si (KR)

(73) Assignee: Supportec Co., Ltd., Seoul (KR)

( * ) Notice: Subject to any disclaimer, the term of this patent is extended or adjusted under 35 U.S.C. 154(b) by 0 days.

(21) Appl. No.: 13/877,150

(22) PCT Filed: Sep. 29, 2011

(86) PCT No.: PCT/KR2011/007204

§ 371 (c)(1),
(2), (4) Date: Mar. 29, 2013

(87) PCT Pub. No.: WO2012/044096

PCT Pub. Date: Apr. 5, 2012

(65) Prior Publication Data

US 2013/0205518 A1 Aug. 15, 2013

(30) Foreign Application Priority Data

Sep. 30, 2010 (KR) ..... 10-2010-0095326

(51) Int. Cl.

| | |
|---|---|
| ***E01D 19/02*** | (2006.01) |
| ***E01D 19/00*** | (2006.01) |
| ***E01D 2/02*** | (2006.01) |
| *E01D 21/00* | (2006.01) |

(52) U.S. Cl.

CPC ..... *E01D 19/00* (2013.01); *E01D 21/00* (2013.01); *E01D 2/02* (2013.01); *E01D 19/02* (2013.01)

USPC ..... 14/75; 14/74.5; 14/77.1; 14/77.3; 52/223.11

(58) Field of Classification Search

CPC ..... E01D 19/02; E01D 21/00; E01D 2101/24; E01D 2/02

USPC ..... 14/74.5, 75, 77.1–78; 52/223.11–223.13, 741.1, 745.19

See application file for complete search history.

(56) References Cited

U.S. PATENT DOCUMENTS 2,583,626 A * 1/1952 Buell ..... 249/102
3,892,096 A * 7/1975 Macchi ..... 52/223.11

(Continued)

FOREIGN PATENT DOCUMENTS

CN 101228321 A 7/2008
JP 2007032232 A 2/2007

(Continued)

OTHER PUBLICATIONS

Korean Intellectual Property Office, International Search Report of PCT/KR2011/007204, WIPO, Apr. 13, 2012, 4 pages.

State Intellectual Property Office of China, First Office Action Issued in Chinese Patent Application No. 201180057785, Aug. 13, 2014, 9 pages.

*Primary Examiner* — Raymond W Addie

(74) *Attorney, Agent, or Firm* — Alleman Hall McCoy Russell & Tuttle LLP

(57) ABSTRACT

An upper structure for a bridge includes a coping placed on the top end of a pier, and a girder held by the coping, wherein a side surface of the coping and an end surface of the girder are configured as inclined surfaces (or vertical surfaces), wherein a shear key protrudes on one of the inclined surfaces (or vertical surfaces), and a shear key slot is formed in another one of the inclined surfaces (or vertical surfaces) so as to be engaged with the shear key. The present disclosure can reduce the construction cost, can realize improved structural efficiency of the bridge upper structure, can realize an easy installation of the girders, can easily combine the girders with the coping without plastering or fixing with mortar by site work, and can efficiently resist to a shear stress that may be generated in the bridge.

17 Claims, 12 Drawing Sheets

(56) References Cited

U.S. PATENT DOCUMENTS

| | | | | |
|---|---|---|---|---|
| 3,959,423 | A * | 5/1976 | Boyd | 264/34 |
| 4,977,636 | A * | 12/1990 | King | 14/73 |
| 5,081,805 | A * | 1/1992 | Jazzar | 52/79.2 |
| 6,588,160 | B1 * | 7/2003 | Grossman | 52/223.7 |
| 7,373,683 | B2 * | 5/2008 | Moon | 14/74.5 |
| 8,316,495 | B2 * | 11/2012 | He | 14/77.1 |
| 8,341,788 | B2 * | 1/2013 | Kim et al. | 14/77.3 |
| 8,458,839 | B2 * | 6/2013 | Porter | 14/77.1 |
| 2009/0064610 | A1 * | 3/2009 | Ahn | 52/223.11 |
| 2009/0064640 | A1 * | 3/2009 | George | 54/44.1 |
| 2013/0263392 | A1 * | 10/2013 | Han | 14/74.5 |

FOREIGN PATENT DOCUMENTS

| | | | |
|---|---|---|---|
| KR | 1020040009056 | A | 1/2004 |
| KR | 100510254 | B1 | 8/2005 |
| KR | 100538410 | B1 | 12/2005 |
| KR | 100785634 | B1 | 12/2007 |
| KR | 1020080074832 | A | 8/2008 |
| KR | 1020090057180 | A | 6/2009 |

* cited by examiner

UPPER STRUCTURE FOR BRIDGE

TECHNICAL FIELD

The present application is the national phase of International Application No. PCT/KR2011/007204, entitled Upper Structure for Bridge, filed Sep. 29, 2011, which claims the benefit of Korean Patent Application No. 10-2010-0095326, filed on Sep. 30, 2010, the contents of each of which are entirely incorporated herein by reference for all purposes. The present disclosure relates generally to upper structures for bridges and, more particularly, to an upper structure for bridges in which a coping and girders behave in an integrated state.

BACKGROUND ART

Generally, bridges are structures that are constructed in various types and various shapes considering the types of objects to be supported by the bridges and to uses of the objects. Further, the bridges function to safely keep up the functions of passageways or facilities supported by the bridges, so the bridges must have a sufficient degree of strength and endurance.

As shown in FIG. 1, a conventional upper structure for bridges includes a coping 2 that is placed on the top end of a pier 1, girders 4 that are held on the coping 2 with the interposition of respective bridge bearings 3, and a deck (not shown) that is laid on the girders 4 and forms a passageway for vehicles.

As shown in FIG. 2, the girders 4, which are placed to be adjacent to each other in a longitudinal direction of a bridge, are arranged continuously on the pier 1 and on the coping 2. Here, the continuous arrangement of the girders may be accomplished in a prestressed state in which a prestressed member (prestressed steel strand) 5 is installed.

DISCLOSURE

Technical Problem

However, in the conventional upper structure for bridges, to realize the continuous arrangement of girders, it is required to necessarily use bridge bearings. Further, in the conventional upper structure for bridges, the girders and the coping are configured to behave individually, and so the conventional upper structure for bridges is mechanically inefficient. Further, in the conventional upper structure for bridges, the coping is excessively exposed to the outside and spoils the appearance of the bridges.

Accordingly, the present disclosure has been made keeping in mind the above problems occurring in the prior art, and an object of the present disclosure is to provide an upper structure for bridge, in which girders can be installed continuously without using conventional bridge bearings, in which a coping and the girders can behave in an integrated state.

Technical Solution

In order to accomplish the above object, the present disclosure provides an upper structure for a bridge, comprising a coping placed on the top end of a pier, and a girder held by the coping, wherein a side surface of the coping and an end surface of the girder are configured as inclined surfaces so as to come into close contact with each other, wherein a shear key protrudes on one of the inclined surfaces, and a shear key slot is formed in another one of the inclined surfaces so as to be engaged with the shear key.

The coping may include: a horizontal part on which a lower surface of an end of the girder is seated in a state in which the lower surface of the end of the girder comes into close contact with the horizontal part, and a vertical part against which the end surface of the girder abuts in a state in which the end surface of the girder comes into close contact with the vertical part.

The shear key and the shear key slot may comprise a plurality of shear keys that are formed in an inclined surface direction and a plurality of shear key slots that are formed in the inclined surface direction.

The shear key or the shear key slot may be continuously or intermittently formed in a longitudinal direction of the coping (a width direction of the bridge).

In the upper structure for the bridge, an inclined surface directional length of the shear key may be shorter than an inclined surface directional length of the shear key slot, and so the shear key can be easily and closely engaged with the shear key slot.

The shear key may protrude from an associated inclined surface so as to form a trapezoidal shape, and the shear key slot may be depressed in an associated inclined surface so as to form a trapezoidal shape.

The shear key may be formed on the coping and may have a protrusion upper surface that is a horizontal surface, and the shear key slot may be formed in the girder and may have a depression upper surface that is a horizontal surface.

The shear key may be formed in the girder and may have a protrusion lower surface that is a horizontal surface, and the shear key slot may be formed in the coping and may have a depression lower surface that is a horizontal surface.

In another aspect, the present disclosure provides an upper structure for a bridge, comprising a coping placed on a top end of a pier, and a girder held by the coping, wherein a side surface of the coping and an end surface of the girder are configured as vertical surfaces so as to come into close contact with each other, wherein a shear key protrudes on one of the vertical surfaces that come into close contact with each other, and a shear key slot is formed in another one of the vertical surfaces so as to be engaged with the shear key.

The shear key may protrude from an associated vertical surface so as to form a saw tooth shape, and the shear key slot may be depressed in an associated vertical surface so as to form a saw tooth shape.

A plurality of prestressed members may be installed in the coping along a longitudinal direction of the coping so as to prestress the bridge in a width direction of the bridge.

The coping and the girder may be connected to each other by a plurality of prestressed members that are installed along a longitudinal direction of the girder so as to prestress the bridge in a longitudinal direction of the bridge.

Advantageous Effects

As described above, the upper structure for a bridge according to the present disclosure is advantageous in that the girders can be installed continuously without using conventional bridge bearings, thereby reducing the construction cost, in that the coping and the girders behave in an integrated state, thereby realizing improved structural efficiency of the bridge upper structure, and in that the junction surfaces of the coping and the girders are configured as inclined surfaces, thereby realizing an easy installation of the girders on the coping, and in that the shear keys are provided on the inclined surfaces of the coping and the girders, thereby easily combining the girders with the coping without plastering or fixing with mortar by site work, and in that the bridge can efficiently resist to a shear stress that may be generated in the structure of the bridge during the use of the bridge.

DESCRIPTION OF REFERENCE CHARACTERS OF IMPORTANT PARTS

Figure 1:
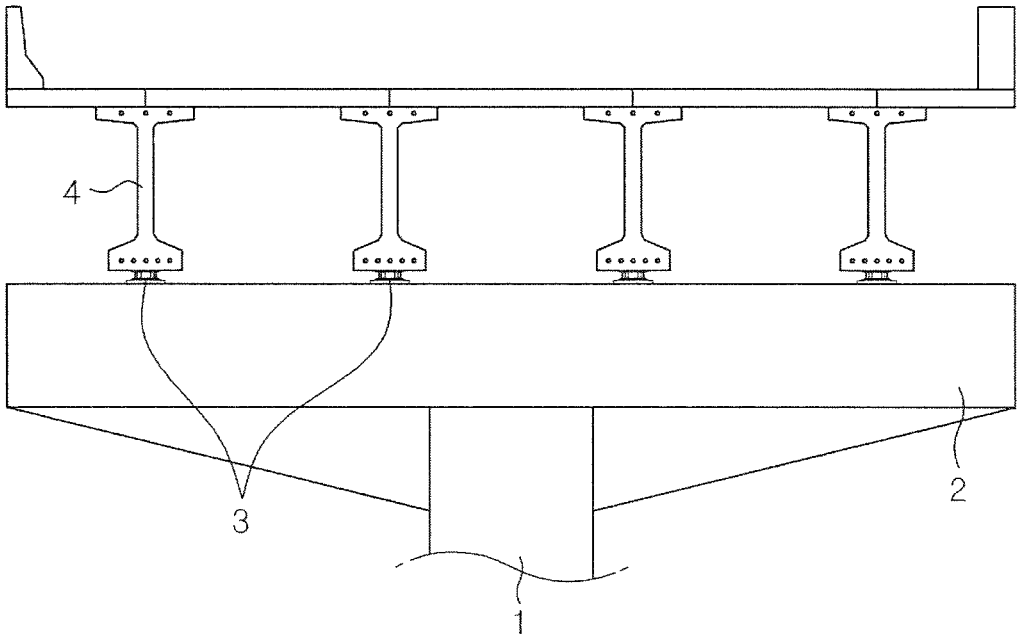
FIG. 1 (Prior Art)
FIG. 1 is a sectional view illustrating a conventional upper structure for bridges.
Figure 2:
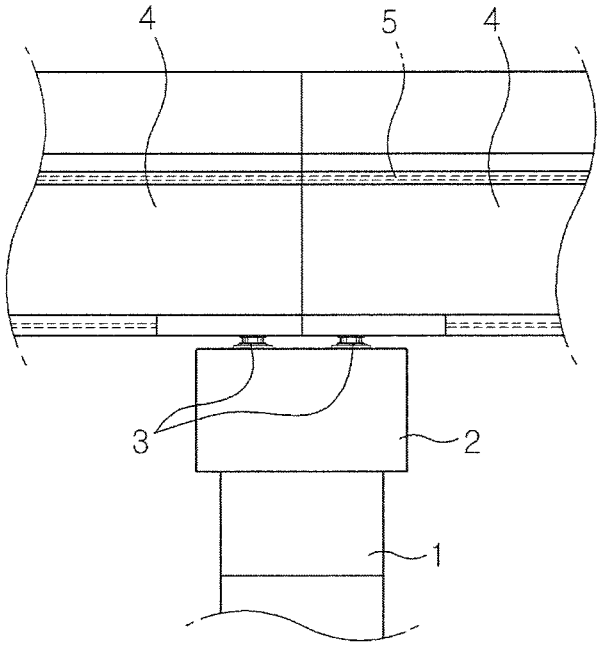
FIG. 2 (Prior Art)
FIG. 2 is a side view of FIG. 1.

110, 210, 310, 410: pier 120, 220, 320, 420: coping
121, 221, 321, 421: horizontal part
122, 222, 322, 422: vertical part
122*a*, 222*a*, 322*a*, 422*a*: inclined surface (or vertical surface)
126, 236, 326, 436: shear key
130, 230, 330, 430, 530: girder
136, 226, 336, 426: shear key slot

BEST MODE

Hereinbelow, embodiments of the present disclosure will be described in detail with reference to the accompanying drawings.

Figure 3:
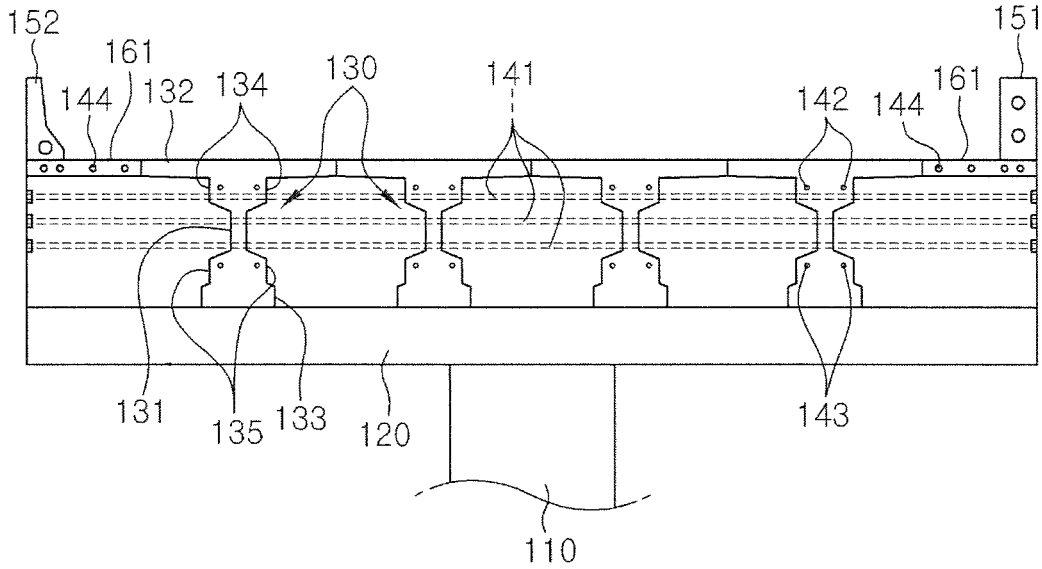
FIG. 3 is a sectional view illustrating an upper structure for a bridge according to a first embodiment of the present disclosure.
Figure 4:
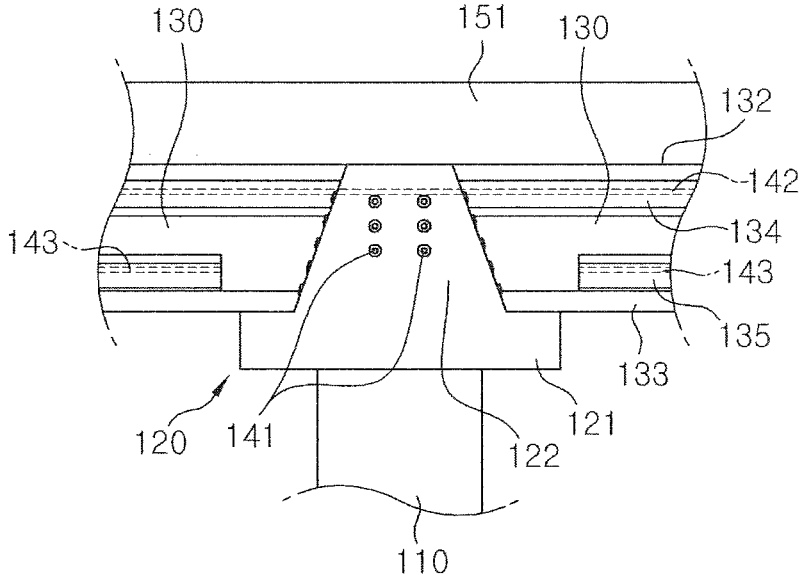
FIG. 4 is a side view of FIG. 3.
Figure 5:
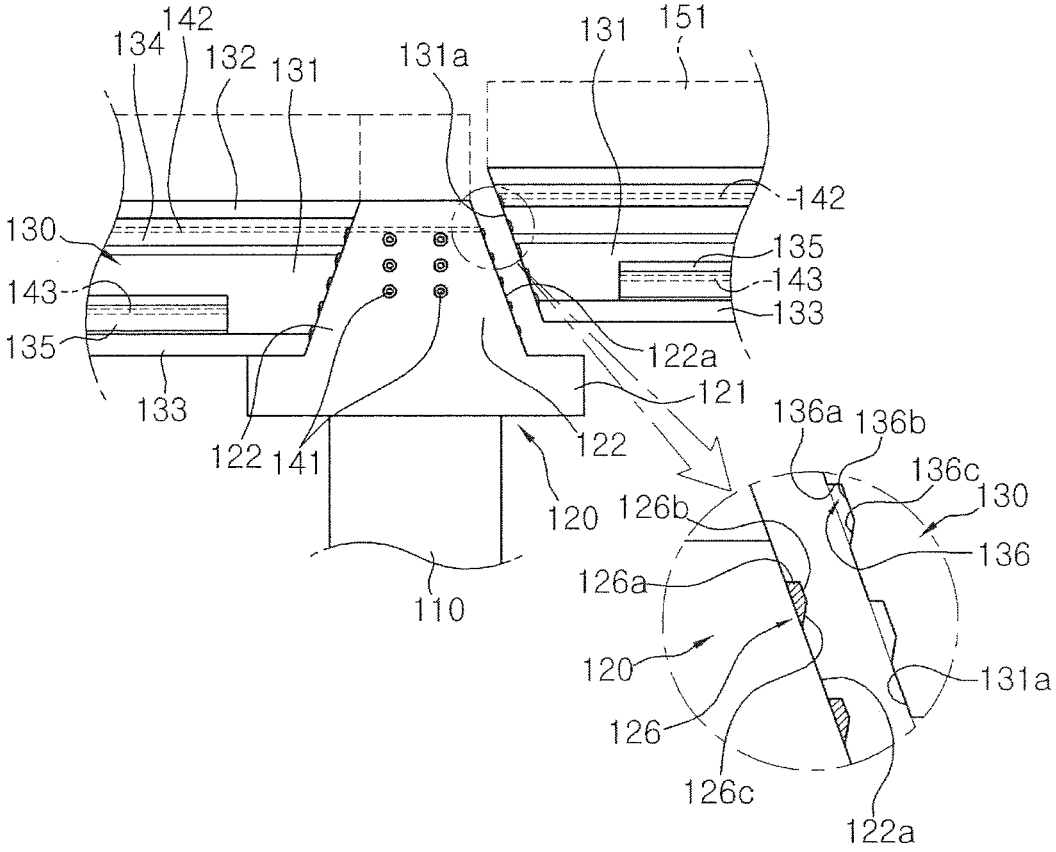
FIG. 5 is a detail view illustrating a state in which one of girders is separated from a coping of the upper structure for the bridge of FIG. 4.
Figure 6A:
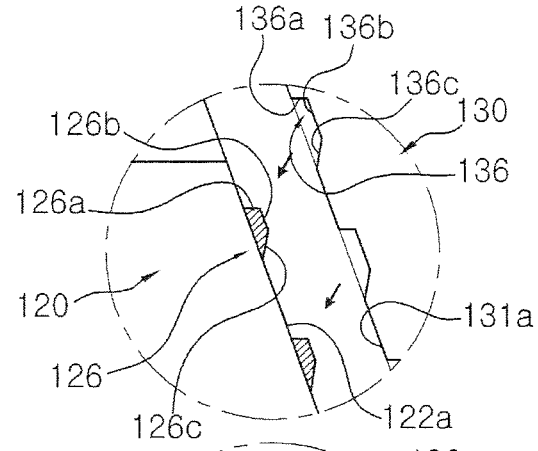
FIGS. 6(*a*) to 6(*d*) are views illustrating a process of installing a girder according to the first embodiment of the present disclosure.
Figure 6B:
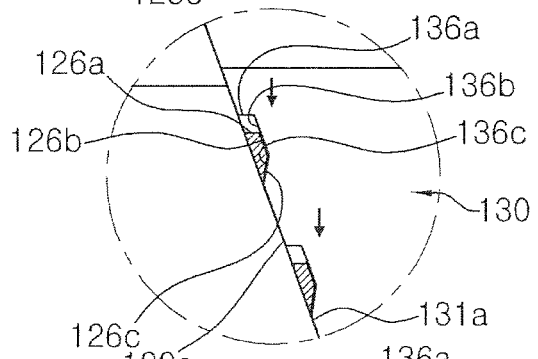
Figure 6C:
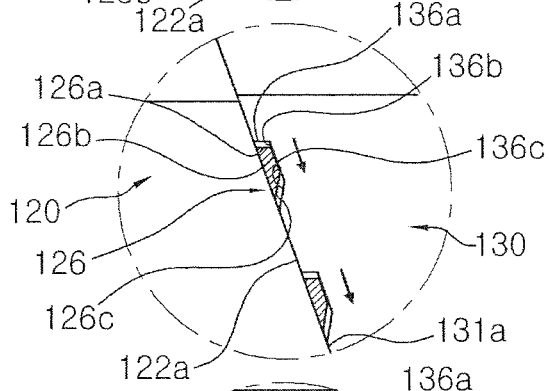
Figure 6D:
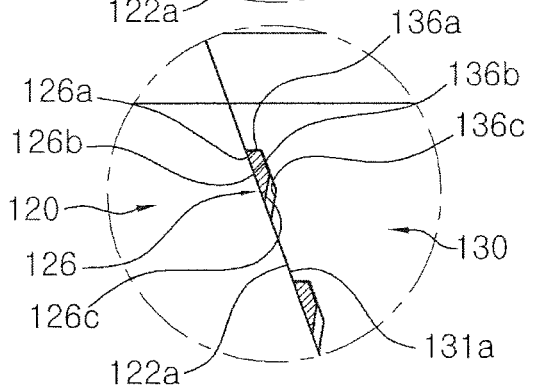

FIG. 3 is a sectional view illustrating an upper structure for a bridge according to a first embodiment of the present disclosure, FIG. 4 is a side view of FIG. 3, and FIG. 5 is a detailed view illustrating a state in which one of girders is separated from a coping of the upper structure for the bridge of FIG. 4.

As shown in the drawings, a coping 120 is placed on the top end of a pier 110, and girders 130 are held by the upper portion of the coping 120 in such a way that the girders 130 extend in longitudinal directions of a bridge while being perpendicular to a longitudinal direction of the coping 120.

The coping 120 is a long concrete structure that extends along a width of the bridge. The coping 120 comprises horizontal parts 121, on which the lower surfaces of ends of respective girders 130 are closely seated, and a vertical part 122, against opposite side surfaces of which the end surfaces of the girders 130 closely abut.

The coping 120 may be configured such that it has a trapezoidal cross-section without having the horizontal parts.

The opposite side surfaces of the vertical part 122 are configured as inclined surfaces 122*a* so that the vertical part 122 forms a trapezoidal cross-section. On each of the inclined surfaces 122*a*, shear keys 126 protrude so as to be engaged with respective shear key slots that are formed on the side surface (inclined surface) of an associated girder 130 as will be described later herein.

To prestress the bridge in a width direction, a plurality of first prestressed members (prestressed steel strands) 141 are installed in the vertical part 122 of the coping 120 along the longitudinal directions of the coping 120. Here, it should be understood that the first prestressed members 141 may be installed in the horizontal parts 121. Here, opposite ends of each of the first prestressed members 141 in a longitudinal direction of the coping 120 are fixed to opposite end surfaces of the horizontal parts 121 or of the vertical part 122 using respective fixtures.

Further, protective walls 151 and 152 are installed on opposite ends of the upper surface of the vertical part 122. Here, the protective walls 151 and 152 may be integrated with respective girders 130 into single structures.

The horizontal parts 121 have flange shapes that protrude outward from the lower end of the vertical part 122 in opposite width directions and extend along the longitudinal directions of the coping 120. The lower surfaces of ends of the girders 130 are closely seated on the upper surfaces of respective horizontal parts 121.

The shear key 126 comprises a plurality of shear keys that are arranged on each of the inclined surfaces 122*a* in a vertical direction. Here, the shear keys 126 are formed continuously or intermittently on the coping 120 in the longitudinal directions of the coping 120.

Further, the shear keys 126 that protrude from the inclined surface 122*a* have a trapezoidal cross-section. Here, each of the shear keys 126 has a protrusion upper surface 126*a* that is a horizontal surface parallel to the upper surfaces of the horizontal parts 121 of the coping 120, a protrusion middle surface 126*b* that is a surface parallel to the inclined surface 122*a*, and a protrusion lower surface 123*c* that extends vertically or inclinedly downward from the lower edge of the protrusion middle surface 126*b* to the inclined surface 122*a*.

In the present disclosure, the coping 120 may be formed by connecting divided coping parts to each other at joints into a single coping. Further, in an effort to reduce the weight of the coping 120, a plurality of hollow openings may be formed in the coping 120.

The girders 130 are concrete structures which are laid on the coping 120 in such a way that they are arranged along the longitudinal directions of the bridge. Here, the girders 130 are perpendicularly placed on the coping 120 along the width direction of the bridge. Further, each of the girders 130 has a modified I-beam structure, in which upper and lower reinforcing parts 134 and 135 are formed at respective locations between a web 131 and upper and lower flanges 132 and 133 of the girder 130. In the embodiment, an end of each of the lower reinforcing parts 135 is cut and removed from the girder 130, as shown in the drawings. However, the lower reinforcing parts 135 may be configured in such a way a part of the ends is not cut or removed.

The upper flange 132 of each girder 130 comes into close contact with the upper flanges 132 of neighboring girders 130 that are perpendicularly arranged along the width direction of the bridge so that the upper flanges 132 of the girders 130 function as a deck bottom plate of the bridge. Further, additional deck bottom plates 161 are installed on opposite ends of the upper surface of the coping 120 in such a way that the deck bottom plates 161 come into close contact with respective upper flanges 132 of the girders 130 that are placed in width directional opposite sides of the bridge. The additional deck bottom plates 161 may be configured as a girder-integrated structure, in which the additional deck bottom plates 161 are integrated with the upper flanges 132 of the girders 130 that are placed in the width directional opposite sides of the bridge.

To prestress the bridge in the longitudinal direction, a plurality of second prestressed members 142 (prestressed steel strands) are installed in the upper reinforcing parts 134 of the girders 130 along the longitudinal directions of the girders 130 in a state in which the prestressed members 142 pass through the coping 120.

To further prestress the bridge in the longitudinal direction, a plurality of third prestressed members 143 (prestressed steel strands) are installed in the lower reinforcing parts 135 of the girders 130 along the longitudinal directions of the girders 130.

The second prestressed members 142 may be installed in the upper and lower flanges 132 and 133. Opposite ends of each of the second and third prestressed members 142 and 143 are fixed to the longitudinal directional opposite ends of the bridge using respective fixtures.

Further, further prestress the bridge in the longitudinal direction, a plurality of fourth prestressed members 144 (prestressed steel strands) are installed in the deck bottom plates 161 along the longitudinal directions of the bridge. However, in the present disclosure, the additional deck bottom plates may be constructed without having the prestressed members.

The end surface (end surface of the web) of each of the girders 130 is configured as an inclined surface 131*a* that comes into close contact with the inclined surface 122*a*. A shear key slot 136 is formed in the inclined surface 131*a* by being depressed so as to be engaged with the shear key 126.

The shear key slot 136 comprises a plurality of shear key slots that are arranged on the inclined surface 131 a in a vertical direction.

Further, the shear key slots 136 that are depressed in the inclined surface 131*a* have a trapezoidal cross-section. Here, each of the depressed shear key slots 136 has a depression upper surface 136*a* that is a horizontal surface parallel to the lower surface of the end of an associated girder 130, a depression middle surface 136*b* that is a surface parallel to the inclined surface 131*a*, and a depression lower surface 136*c* that extends vertically or inclinedly downward from the lower edge of the depression middle surface 136*b* to the inclined surface 131*a*.

Further, to realize an easy and close contact engagement of the shear keys 126 with the respective shear key slots 136, the inclined surface directional length of each of the shear keys 126 is shorter than the inclined surface directional length of an associated shear key slot 136.

FIGS. 6(*a*) to 6(*d*) are views illustrating a process of installing a girder according to the first embodiment of the present disclosure. As shown in the drawings, to install the girder 130 on the coping 120 in the first embodiment, the girder 130 having the shear key slots 136 is lowered vertically from the top such that the shear key slots 136 can be engaged with the respective shear keys 126 of the coping 120, thereby bringing the two inclined surfaces 131*a* and 122*a* into close contact with each other.

In other words, first, the inclined surface 131*a* of the girder 130 having the shear key slots 136 is lowered onto the inclined surface 122*a* of the coping 120 having the shear keys 126 (FIG. 6(*a*)). Second, the two inclined surfaces 131*a* and 122*a* are brought into close contact with each other in a state in which the shear keys 126 are aligned with the respective shear key slots 136 such that the shear keys 126 and the shear key slots 136 can be engaged with each other (FIG. 6(*b*)). In the above state, since the length of each shear key slot 136 is longer than the length of each shear key 126, the depression lower surface 136*c* of the shear key slot 136 primarily comes into close contact with the protrusion lower surface 126*c* of the shear key 126, thereby forming a space at a location above the shear key 126.

Thereafter, the girder 130 is lowered such that the inclined surface 131*a* of the girder 130 can slide downward along the inclined surface 122*a* of the coping 120 (FIG. 6(*c*)). Therefore, the depression upper surface 136*a* of the shear key slot 136 comes into close contact with the protrusion upper surface 126*a* of the shear key 126 (FIG. 6(*d*)), and so the lower surface of the end of the girder 130 comes into close contact with the upper surface of the horizontal part 121 of the coping 120, and the inclined surface 131*a* of the girder 130 comes into contact with the inclined surface 122*a* of the coping 120, thereby holding the girder 130 on the coping 120.

Thereafter, the second prestressed members 142 are installed by passing the second prestressed members 142 through the coping 120 along the longitudinal directions of the girder 130 (although the second prestressed members are shown in a separated state in FIG. 5, the second prestressed members are continuously installed after the girder is held on the coping). Thereafter, the protective walls 151 and 152 are installed on the girders 130 and on the coping 120, thereby forming an upper structure for the bridge. The assembled upper structure is paved with cement or asphalt, thereby finishing the construction of a bridge. In the above-mentioned procedure, the first prestressed members 141 are previously installed in the coping 120, and the third and fourth prestressed members are previously installed in the girders 130. Here, the protective walls 152 may be integrally installed on the girders 130 and on the coping 120 after the girders 130 are assembled with the coping 120. Alternatively, the protective walls 152 may be installed on the girders 130 and on the coping 120 prior to assembling the girders 130 with the coping 120.

Figure 7:
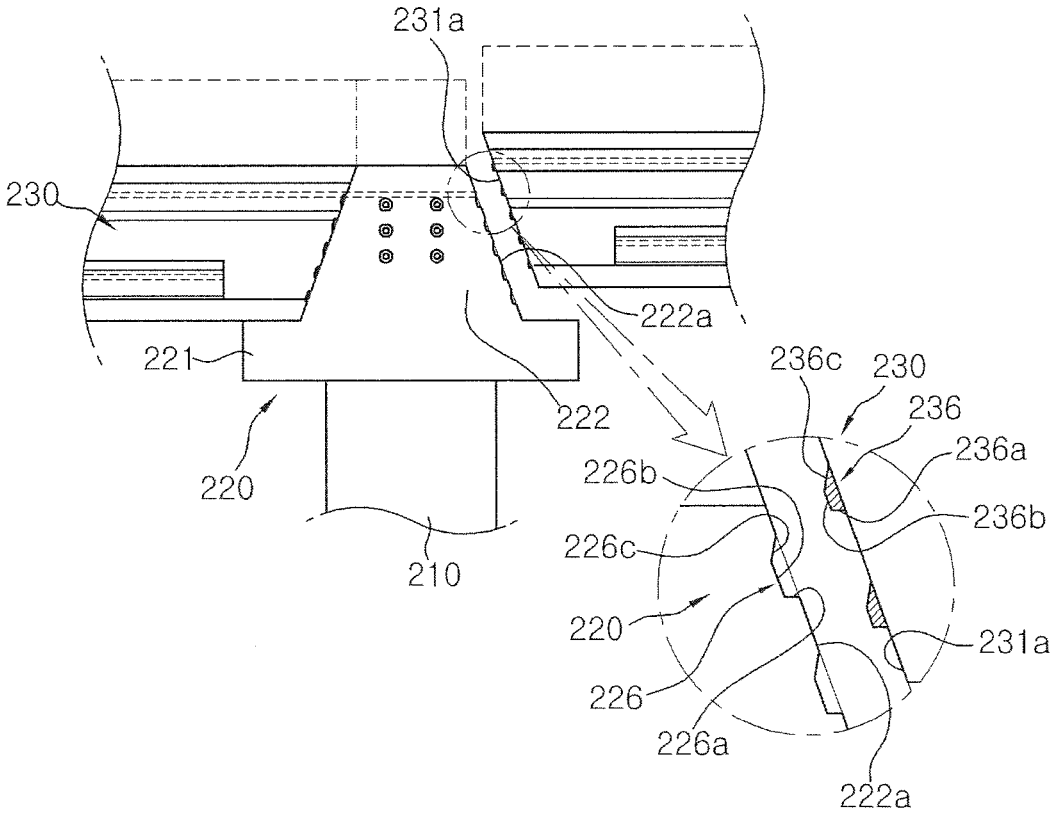
FIG. 7 is a detailed view illustrating a state in which one of girders is separated from a coping of an upper structure for the bridge according to a second embodiment of the present disclosure.
Figure 8A:
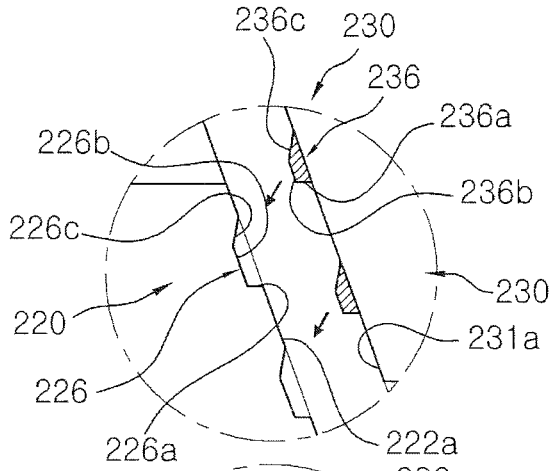
FIGS. 8(*a*) to 8(*d*) are views illustrating a process of installing a girder according to the second embodiment of the present disclosure.
Figure 8B:
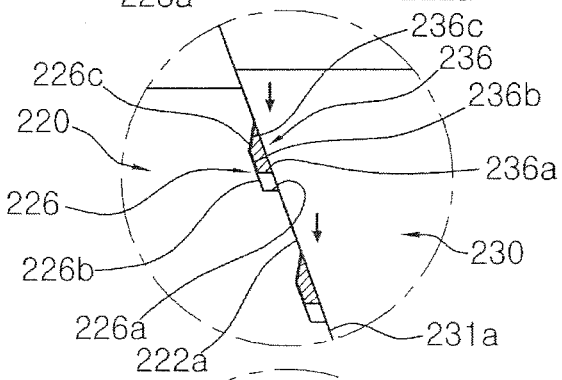
Figure 8C:
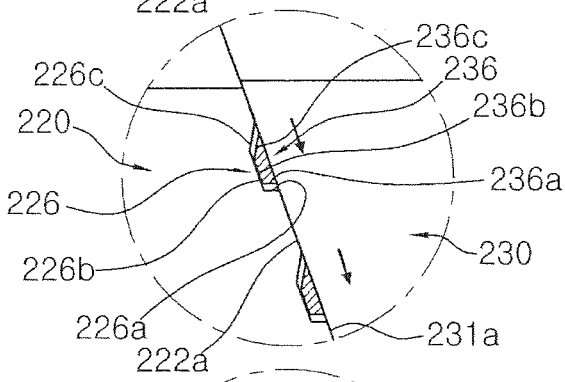
Figure 8D:
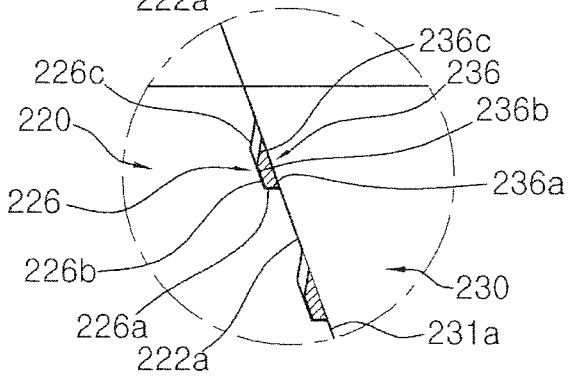

FIG. 7 is a detailed view illustrating a state in which one of girders is separated from a coping of an upper structure for the bridge according to a second embodiment of the present disclosure. In this embodiment (second embodiment), shear keys 236 are formed on each girder 230, in which a protrusion lower surface 236*a* of each of the shear keys 236 is configured as a horizontal surface parallel to the lower surface of an end of the girder 230. Further, shear key slots 226 are formed in a coping 220, in which depression lower surface 226*a* is configured as a horizontal surface parallel to the upper surfaces of horizontal parts 221 of the coping 220.

The shear keys 236 that protrude from an inclined surface 231*a* of the girders 230 have a trapezoidal cross-section. Here, each of the shear keys 236 has the protrusion lower surface 236*a* that is the horizontal surface parallel to the lower surface of the end of the girder 230, a protrusion middle surface 236*b* that is a surface parallel to the inclined surface 231*a*, and a protrusion upper surface 236*c* that extends vertically or inclinedly upward from the upper edge of the protrusion middle surface 236*b* to the inclined surface 231*a*.

The shear key slots 226 that are depressed from an inclined surface 222*a* of the coping 220 have a trapezoidal cross-section. Here, each of the shear key slots 226 has the depression lower surface 226*a* that is the horizontal surface parallel to the upper surfaces of the horizontal parts 221 of the coping 220, a depression middle surface 226*b* that is a surface parallel to the inclined surface 222*a*, and a depression upper surface 226*c* that extends vertically or inclinedly upward from the upper edge of the depression middle surface 226*b* to the inclined surface 222*a*.

Here, to realize an easy and close contact engagement of the shear keys 236 with the respective shear key slots 226, the inclined surface directional length of each of the shear keys 236 is shorter than the inclined surface directional length of an associated shear key slot 226.

In the second embodiment, the construction of a pier 210, the coping 220, the girders 230, prestressed members and protective walls remains the same as that of the first embodiment and further explanation is thus not deemed necessary.

FIGS. 8(*a*) to 8(*d*) are views illustrating a process of installing one of the girders according to the second embodiment of the present disclosure. As shown in the drawings, to install the girder 230 of the second embodiment, the girder 230 having the shear keys 236 is lowered from the top such that the shear keys 236 can be engaged with the respective shear key slots 226 of the coping 220, thereby bringing the two inclined surfaces 231*a* and 222*a* into close contact with each other.

In other words, first, the inclined surface 231*a* of the girder 230 having the shear keys 236 is lowered onto the inclined surface 222*a* of the coping 220 having the shear key slots 226 (FIG. 8(*a*)). Second, the two inclined surfaces 231*a* and 222*a* are brought into close contact with each other in a state in which the shear keys 236 are aligned with the respective shear key slots 226 such that the shear keys 236 and the shear key slots 226 can be engaged with each other (FIG. 8(*b*)). In the above state, since the length of each shear key slot 226 is longer than the length of each shear key 236, the protrusion upper surface 236*c* of the shear key 236 primarily comes into close contact with the depression upper surface 226*c* of the shear key slot 226, thereby forming a space at a location below the shear key 236.

Thereafter, the girder 230 is lowered such that the inclined surface 231*a* of the girder 230 can slide downward along the inclined surface 222*a* of the coping 220 (FIG. 8(*c*)). Therefore, the protrusion lower surface 236*a* of the shear key 236 comes into close contact with the depression lower surface 226*a* of the shear key slot 226 (FIG. 8(*d*)), and so the lower surface of the end of the girder 230 comes into close contact with the upper surface of the horizontal part 221 of the coping 220, and the inclined surface 231*a* of the girder 230 comes into contact with the inclined surface 222*a* of the coping 220, thereby holding the girder 230 on the coping 220.

After the shear keys 126, 236 are engaged with the respective shear key slots 136, 226, spaces formed in the junctions may be charged with epoxy or the like.

Figure 9:
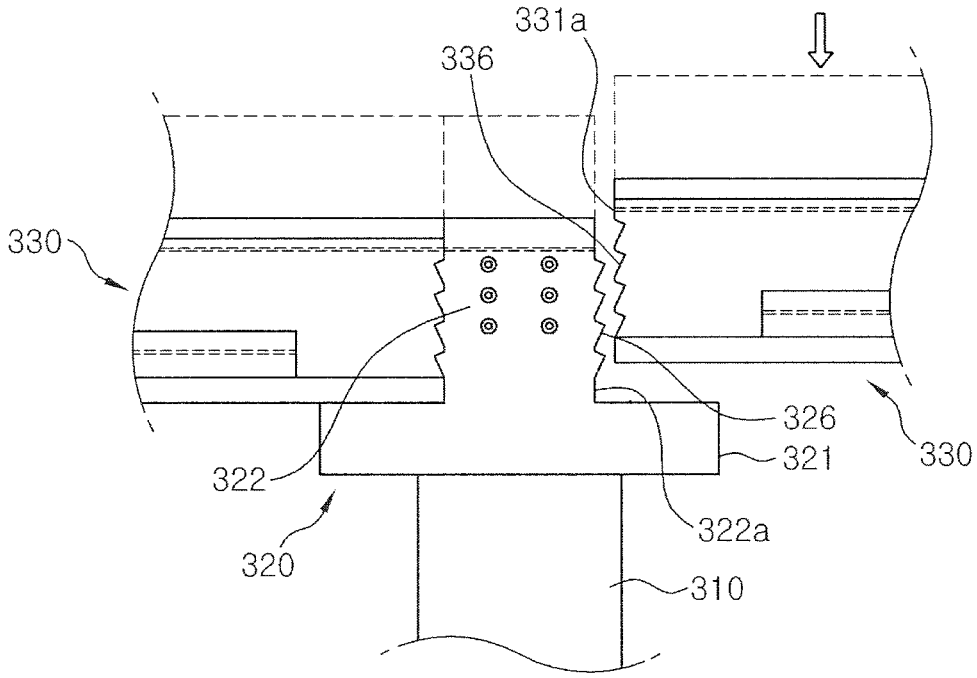
FIG. 9 is a detailed view illustrating a state in which one of girders is separated from a coping of an upper structure for the bridge according to a third embodiment of the present disclosure.

FIG. 9 is a detailed view illustrating a state in which one of girders is separated from a coping of an upper structure for the bridge according to a third embodiment of the present disclosure. As shown in the drawing, this embodiment (third embodiment) is configured such that a coping 320 is placed on the top end of a pier 310, and girders 330 are held by the coping 320 in such a way that the girders 330 extend in longitudinal directions of a bridge while being perpendicular to a longitudinal direction of the coping 320. The coping 320 includes horizontal parts 321 on which lower surfaces of ends of the respective girders 330 are seated in a state in which the lower surfaces come into close contact with the upper surfaces of the horizontal parts 321. The coping 320 further includes a vertical part 322, against opposite side surfaces of which end surfaces of the girders 330 closely abut. Here, the opposite side surfaces 322*a* of the vertical part 322 of the coping 320 and the end surfaces 331*a* of the girders 330 are configured as vertical surfaces that come into close contact with each other.

Here, shear keys 326 protrude on the opposite side surfaces 322*a* of the vertical part 322 of the coping 320, and shear key slots 336 that function to be engaged with the shear keys 326 are formed in the end surfaces 331*a* of the girders 330, in which the shear keys 326 protrude on the opposite side surfaces (vertical surfaces) 322*a* so as to form a saw tooth shape, and the shear key slots 336 are depressed in the end surfaces (vertical surfaces) 331*a* so as to form a saw tooth shape.

Figures 10A, 10B:
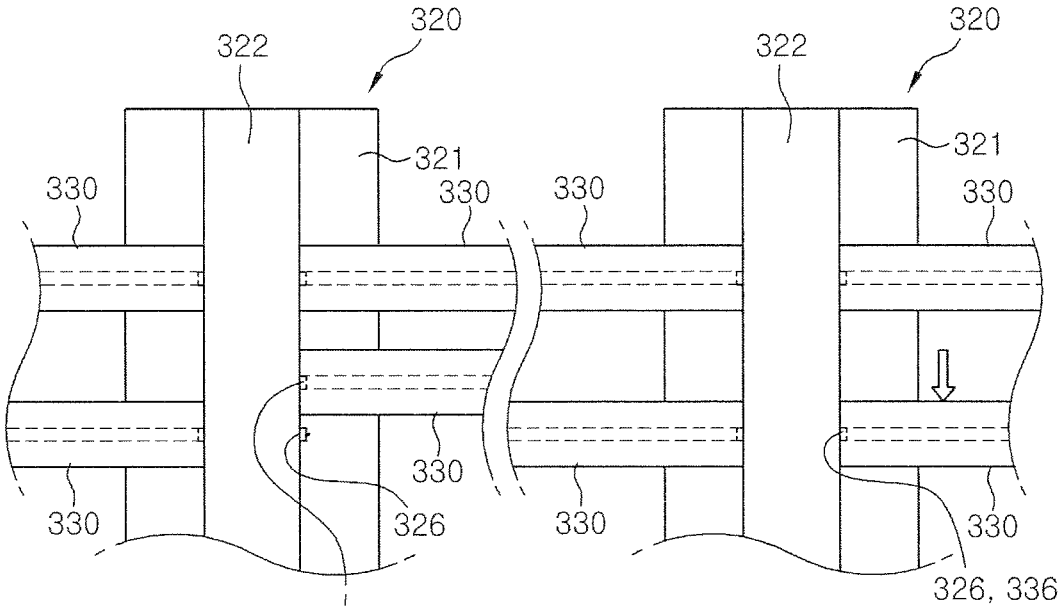
FIGS. 10(*a*) and 10(*b*) are views (plan views) illustrating an installation of girders according to the third embodiment of the present disclosure.

FIGS. 10(*a*) and 10(*b*) are views (plan views) illustrating an installation of the girders according to the third embodiment of the present disclosure. As shown in the drawings, to install a girder of the third embodiment, first, the girder 330 is lowered vertically onto a designated horizontal part 321 at a location beside a portion having the shear keys 326 (in the longitudinal direction of the coping) (FIG. 10(*a*)), and, thereafter, the girder 330 is pushed horizontally (in the longitudinal direction of the coping), thereby bringing the shear keys 326 into engagement with the respective shear key slots 336.

Figure 11:
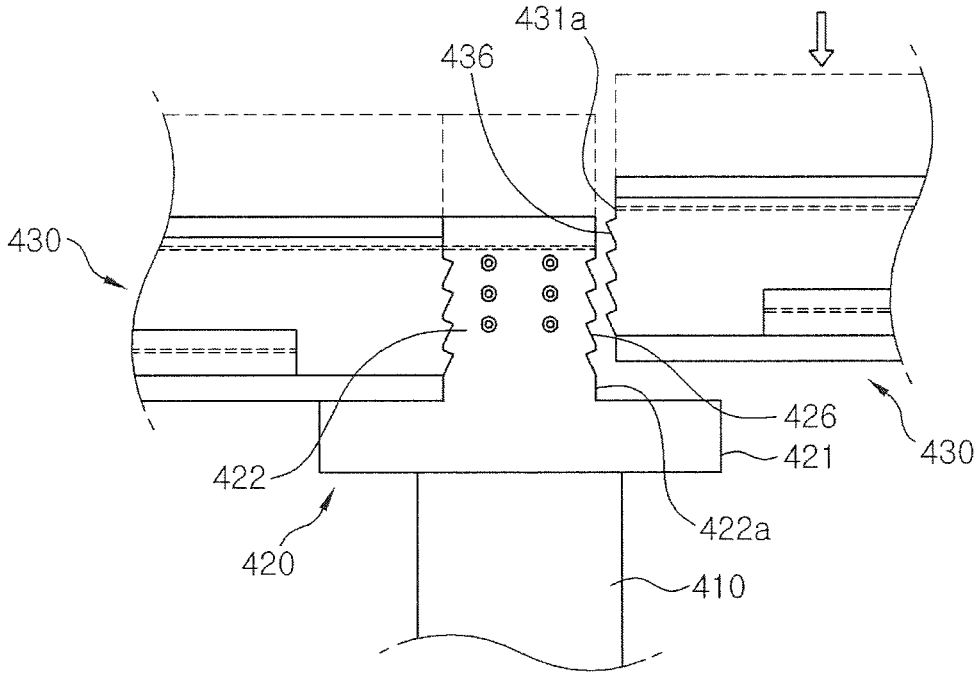
FIG. 11 is a detailed view illustrating a state of one of girders is separated from a coping of an upper structure for the bridge according to a fourth embodiment of the present disclosure.

FIG. 11 is a detailed view illustrating a state of one of girders is separated from a coping of an upper structure for the bridge according to a fourth embodiment of the present disclosure. As shown in the drawing, this embodiment (fourth embodiment) is configured such that a coping 420 is placed on the top end of a pier 410, and girders 430 are held by the coping 420 in such a way that the girders 430 extend in longitudinal directions of a bridge while being perpendicular to a longitudinal direction of the coping 420. The coping 420 includes horizontal parts 421 on which lower surfaces of ends of the respective girders 430 are seated in a state in which the lower surfaces come into close contact with the upper surfaces of the horizontal parts 421. The coping 420 further includes a vertical part 422, against opposite side surfaces of which end surfaces of the girders 430 closely abut. Here, the opposite side surfaces 422*a* of the vertical part 422 of the coping 420 and the end surfaces 431*a* of the girders 430 are configured as vertical surfaces that come into close contact with each other.

Here, shear keys 436 protrude on the end surfaces 431*a* of the girders 430, and shear key slots 426 that function to be engaged with the shear keys 436 are formed in the opposite side surfaces 422*a* of the vertical part 422 of the coping 420. The shear keys 436 protrude on the end surfaces (vertical surfaces) 431*a* of the girders so as to form a saw tooth shape, and the shear key slots 426 are depressed in the opposite side surfaces (vertical surfaces) 422*a* of the vertical part of the coping so as to form a saw tooth shape.

Further, in the opposite side surfaces 422*a* of the vertical part 422 of the coping 420, girder seats 427 (see FIG. 12) for seating therein the ends (ends having the shear keys) of the girders 430 are formed by being depressed at locations beside the portions having the shear key slots 426 (in the longitudinal directions of the coping).

Figures 12A, 12B:
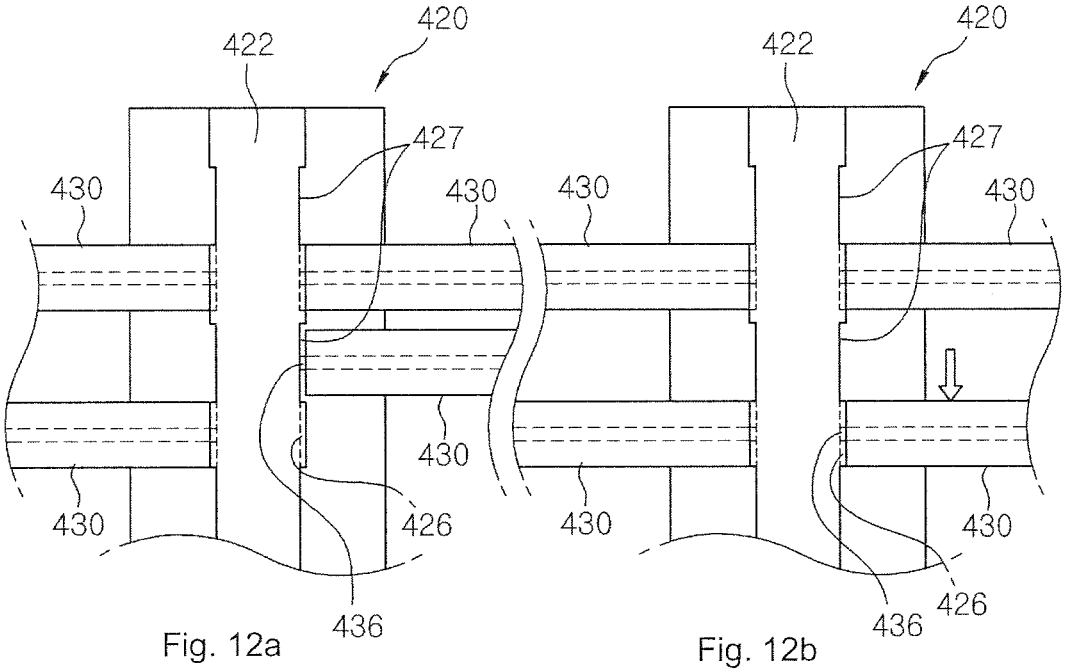
FIGS. 12(*a*) and 12(*b*) are views (plan views) illustrating an installation of girders according to the fourth embodiment of the present disclosure.

FIGS. 12(*a*) and 12(*b*) are views (plan views) illustrating an installation of the girders according to the fourth embodiment of the present disclosure. As shown in the drawings, to install a girder of the fourth embodiment, first, the girder 430 is lowered vertically onto a designated horizontal part 421 at a location beside a portion having the shear key slots 426 (in the longitudinal direction of the coping) (FIG. 12(*a*)).

In the above case, the end (the end having the shear keys) of the girder 430 is seated in a designated girder seat 427.

Thereafter, the girder 330 is pushed horizontally (in the longitudinal direction of the coping), thereby bringing the shear keys 436 into engagement with the respective shear key slots 426.

In the first to fourth embodiments of the present disclosure, the girders 130, 230, 330, 430 are bottom plate-integrated type of girders, in which the girders are integrated with deck bottom plates.

Figure 13:
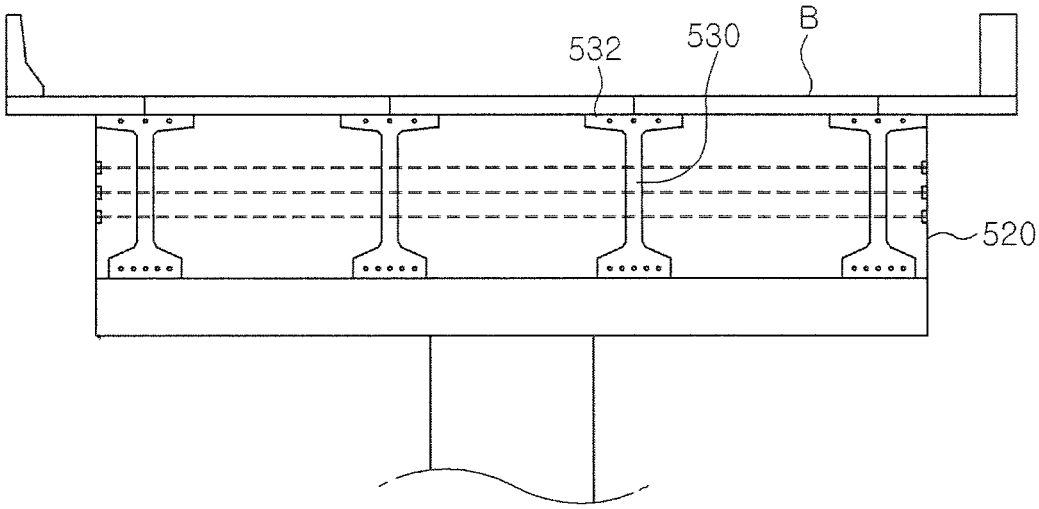
FIG. 13 is a sectional view illustrating an upper structure for the bridge according to a fifth embodiment (bottom plate-separated type of girder) of the present disclosure.

FIG. 13 is a sectional view illustrating an upper structure for the bridge according to an embodiment (fifth embodiment) of the present disclosure, in which girders 530 that are separated from deck bottom plates B are installed. In this embodiment, the girders (bottom plate-separated type of girders) 530 are assembled with a coping in such a way that the upper surfaces of upper flanges 532 of the girders 530 are level with the upper surface of a coping 520. Thereafter, additional deck bottom plates B are closely attached to the upper surfaces of the girders 530.

The construction of the other elements of this embodiment (having the bottom plate-separated type of girders) remains the same as those of the first to fourth embodiments (having the bottom plate-integrated type of girders) and further explanation is thus not deemed necessary.

Although the preferred embodiments of the present disclosure have been disclosed for illustrative purposes, those skilled in the art will appreciate that various modifications, additions and substitutions are possible, without departing from the scope and spirit of the disclosure as disclosed in the accompanying claims.

What is claimed is:

1. An upper structure for a bridge, comprising:

a coping placed on a top end of a pier, and a girder held by the coping, wherein a side surface of the coping and an end surface of the girder are configured as inclined surfaces so as to come into close contact with each other, wherein a shear key protrudes on one of the inclined surfaces, and a shear key slot is formed in another one of the inclined surfaces so as to be engaged with the shear key.

2. The upper structure for the bridge as set forth in claim 1, wherein the coping comprises:

a horizontal part on which a lower surface of an end of the girder is seated in a state in which the lower surface of the end of the girder comes into close contact with the horizontal part, and a vertical part against which the end surface of the girder abuts in a state in which the end surface of the girder comes into close contact with the vertical part.

3. The upper structure for the bridge as set forth in claim 1, wherein the shear key and the shear key slot comprise a plurality of shear keys that are formed in an inclined surface direction and a plurality of shear key slots that are formed in the inclined surface direction.

4. The upper structure for the bridge as set forth in claim 1, wherein the shear key or the shear key slot is continuously formed in a longitudinal direction of the coping.

5. The upper structure for the bridge as set forth in claim 1, wherein the shear key or the shear key slot is intermittently formed in a longitudinal direction of the coping.

6. The upper structure for the bridge as set forth in claim 1, wherein an inclined surface directional length of the shear key is shorter than an inclined surface directional length of the shear key slot, so that the shear key is easily and closely engaged with the shear key slot.

7. The upper structure for the bridge as set forth in claim 1, wherein the shear key protrudes from an associated inclined surface so as to form a trapezoidal shape, and the shear key slot is depressed in an associated inclined surface so as to form a trapezoidal shape.

8. The upper structure for the bridge as set forth in claim 1, wherein the shear key is formed on the coping and has a protrusion upper surface that is a horizontal surface, and the shear key slot is formed in the girder and has a depression upper surface that is a horizontal surface.

9. The upper structure for the bridge as set forth in claim 1, wherein the shear key is formed in the girder and has a protrusion lower surface that is a horizontal surface, and the shear key slot is formed in the coping and has a depression lower surface that is a horizontal surface.

10. The upper structure for the bridge as set forth in claim 1, wherein a plurality of prestressed members are installed in the coping along a longitudinal direction of the coping so as to prestress the bridge in a width direction of the bridge.

11. The upper structure for the bridge as set forth in claim 1, wherein the coping and the girder are connected to each other by a plurality of prestressed members that are installed along a longitudinal direction of the girder so as to prestress the bridge in a longitudinal direction of the bridge.

12. An upper structure for a bridge, comprising:

a coping placed on a top end of a pier, and a girder held by the coping, wherein a side surface of the coping and an end surface of the girder are configured as vertical surfaces so as to come into close contact with each other, wherein a shear key protrudes on one of the vertical surfaces, and a shear key slot is formed in another one of the vertical surfaces so as to be engaged with the shear key.

13. The upper structure for the bridge as set forth in claim 12, wherein the shear key protrudes from an associated vertical surface so as to form a saw tooth shape, and the shear key slot is depressed in an associated vertical surface so as to form a saw tooth shape.

14. The upper structure for the bridge as set forth in claim 12, wherein a plurality of prestressed members are installed in the coping along a longitudinal direction of the coping so as to prestress the bridge in a width direction of the bridge.

15. The upper structure for the bridge as set forth in claim 12, wherein the coping and the girder are connected to each other by a plurality of prestressed members that are installed along a longitudinal direction of the girder so as to prestress the bridge in a longitudinal direction of the bridge.

16. The upper structure for bridge as set forth in claim 12, wherein a plurality of prestressed members are installed in the coping along an longitudinal direction of the coping so as to prestress the bridge in a width direction of the bridge.

17. The upper structure for bridge as set forth in claim 12, wherein the coping and the girder are connected to each other by a plurality of prestressed members that are installed along an longitudinal direction of the girder so as to prestress the bridge in an longitudinal direction of the bridge.

* * * * *